US005533921A

United States Patent [19]

Wilkinson

[11] Patent Number: 5,533,921

[45] Date of Patent: Jul. 9, 1996

[54] REMOTE CONTROLLED MOVABLE BALL AMUSEMENT DEVICE

[76] Inventor: William T. Wilkinson, P.O. Box 73, Salem, N.J. 08079

[21] Appl. No.: 442,891

[22] Filed: May 17, 1995

Related U.S. Application Data

[62] Division of Ser. No. 233,451, Apr. 26, 1994, Pat. No. 5,439,408.

[51] Int. Cl.[6] ..... A63H 5/00; A63H 30/04; A63H 29/00

[52] U.S. Cl. ..... 446/409; 446/456; 446/458

[58] Field of Search ..... 446/409, 456, 446/458, 462, 437, 454, 445; 273/58 K, 58 G; 180/21; 280/206, 207

[56] References Cited

U.S. PATENT DOCUMENTS 3,312,013 4/1967 Graves ..... 446/462 X 4,601,675 7/1986 Robinson ..... 446/456 X

FOREIGN PATENT DOCUMENTS 1184170 7/1959 France ..... 273/58 K 6407 of 1914 United Kingdom ..... 273/58 K

*Primary Examiner*—Mickey Yu

*Attorney, Agent, or Firm*—Connolly & Hutz

[57] ABSTRACT

A remote controlled movable ball amusement device includes a hollow sphere having two propulsion mechanisms within the sphere, with each mechanism driven on a separate track. Each propulsion mechanism includes a receiver and a drive unit. The drive unit causes the sphere to move when actuated by the receiver. A remote transmitter sends signals to the receiver for causing the actuation of the drive unit.

10 Claims, 5 Drawing Sheets

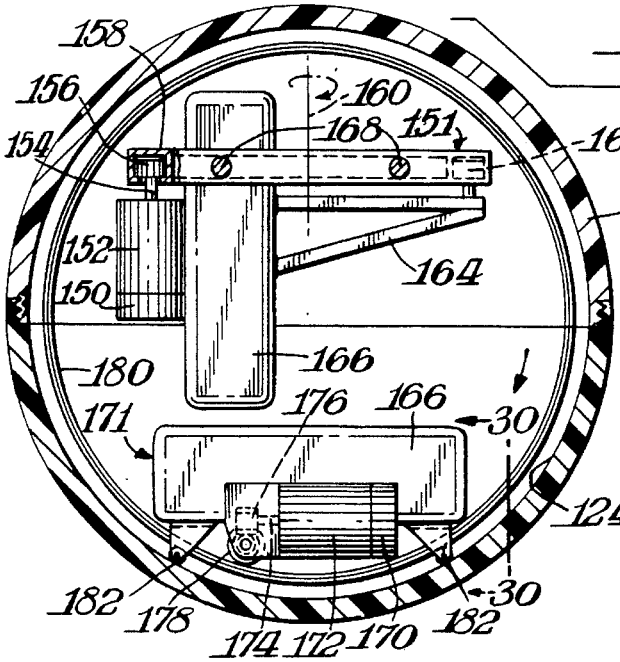
Fig.29.
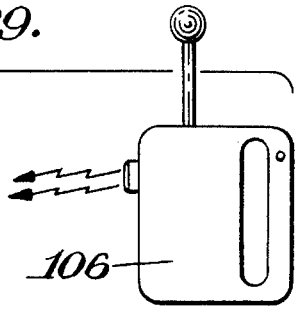
Fig.30.
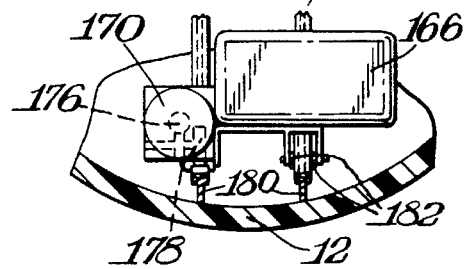
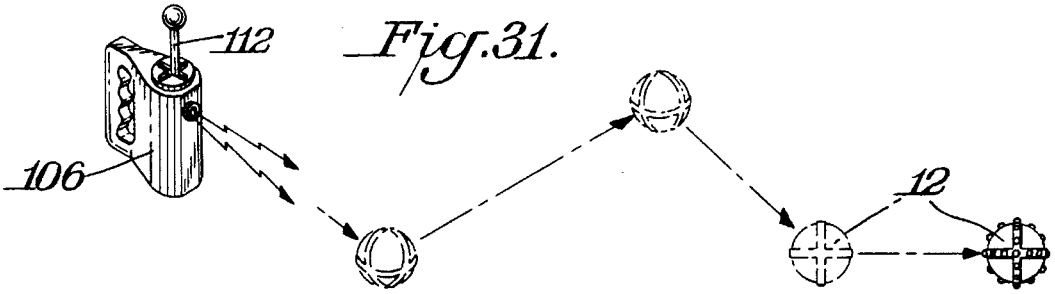
Fig.31.
Fig.32.
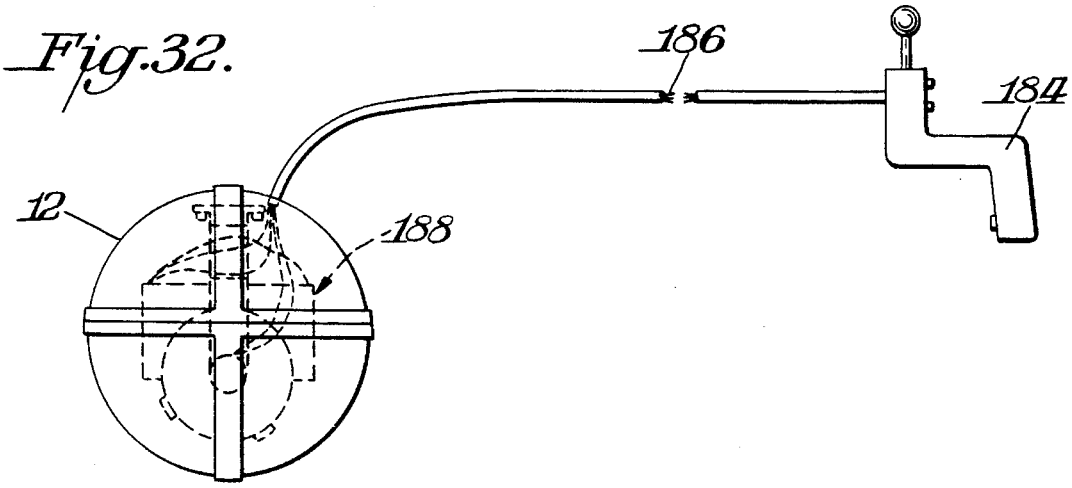

REMOTE CONTROLLED MOVABLE BALL AMUSEMENT DEVICE

CROSS-REFERENCE TO RELATED APPLICATION

This application is a division of application Ser. No. 08/233,451, filed Apr. 26, 1994 now U.S. Pat. No. 5,439,408.

BACKGROUND OF THE INVENTION

One of the oldest types of toys is a ball. Balls have been used for various amusement devices ranging from basic rolling and throwing games to more sophisticated games having varying degrees of rules.

In recent times radio controlled toy vehicles, such as cars and airplanes have become quite popular. An advantage of these remote controlled vehicles is the ability to control the direction of movement of such toys. This advantage is not shared by conventional balls. Attempts have been made to provide some variety in the entertainment value of balls by incorporating different mechanisms that cause the balls to move in a random manner when thrown or rolled. Heretofore, however, the advantages of remote controlled vehicles have not been incorporated into balls.

SUMMARY OF THE INVENTION

An object of this invention is to provide a remote controlled ball which permits the user to control the direction of movement of the ball.

A further object of this invention is to provide such a remote controlled ball which may be readily manufactured and easily operated.

In accordance with this invention the remote controlled movable ball amusement device comprises a hollow sphere. A propulsion mechanism is mounted in the sphere. The propulsion mechanism includes a receiver and a drive unit which is actuated by the receiver for causing the sphere to move. The actuation is accomplished by means of a remote transmitter which sends signals to the receiver.

In a preferred practice of this invention the sphere is formed in two segments such as hemispheres which are secured together after the propulsion mechanism has been installed. The transmitter preferably includes a joy stick which can be manipulated to control the direction of the ball as well as its speed.

The drive unit preferably includes a motor which drives an eccentrically mounted weight. In a preferred practice of the invention two motors are provided for providing a forward/backward movement as well as a side to side movement.

The ball may incorporate lights and audio means to provide added entertainment.

THE DRAWINGS

FIGS. 3–4 are cross-sectional views taken through

Figure 1:
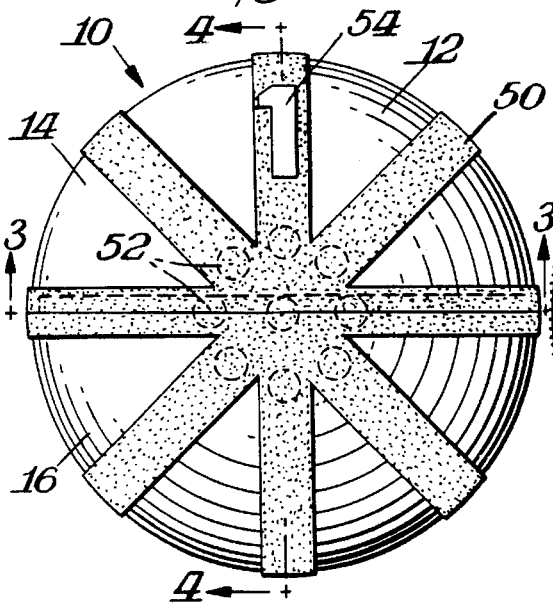
FIG. 1 is a side elevational view of a remote controlled movable ball amusement device in accordance with this invention.
Figure 2:
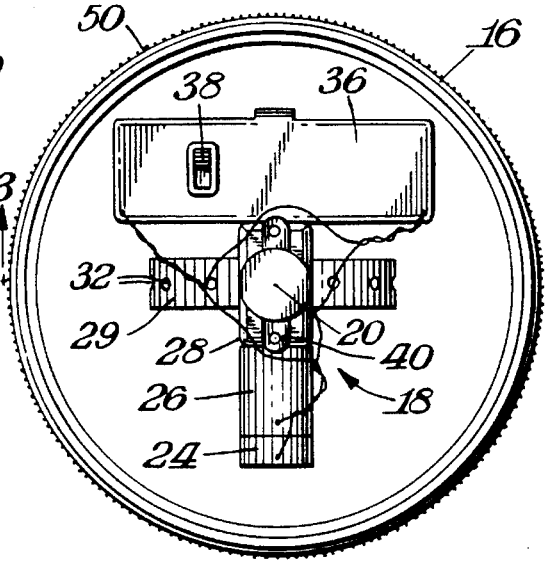
FIG. 2 is a top plan view of the lower segment of the ball shown in FIG. 1 and showing the propulsion mechanism mounted therein.
Figure 3:
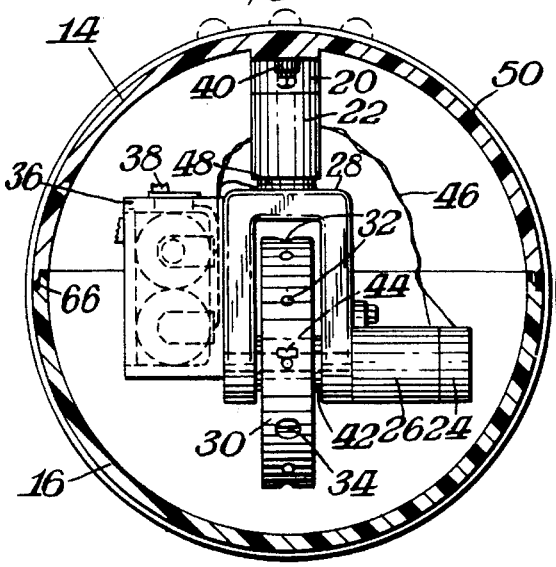
Figure 4:
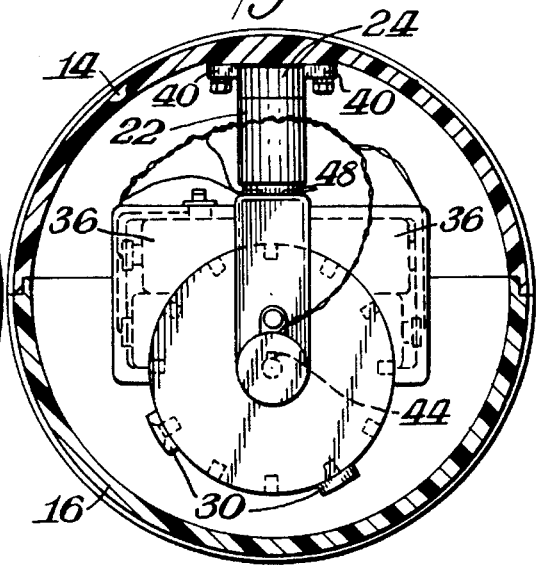
Figure 5:
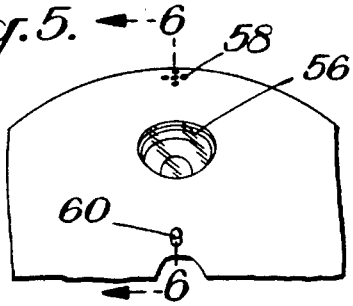
Figure 6:
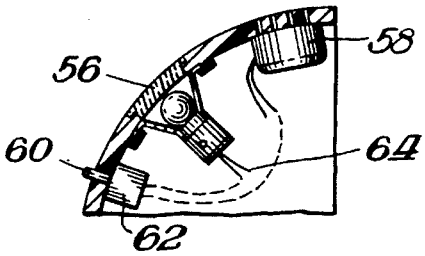
Figure 11:
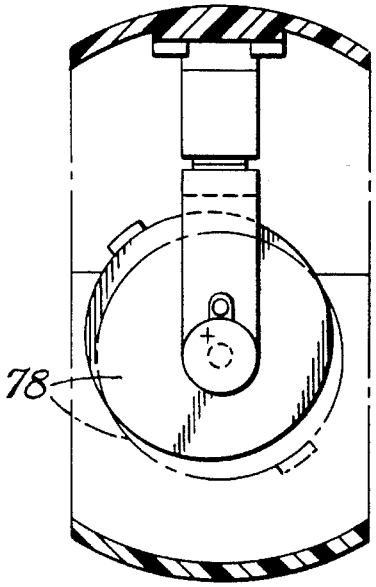
Figure 12:
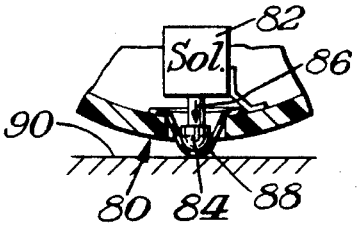
Figures 13, 14, 15, 16, 17, 18:
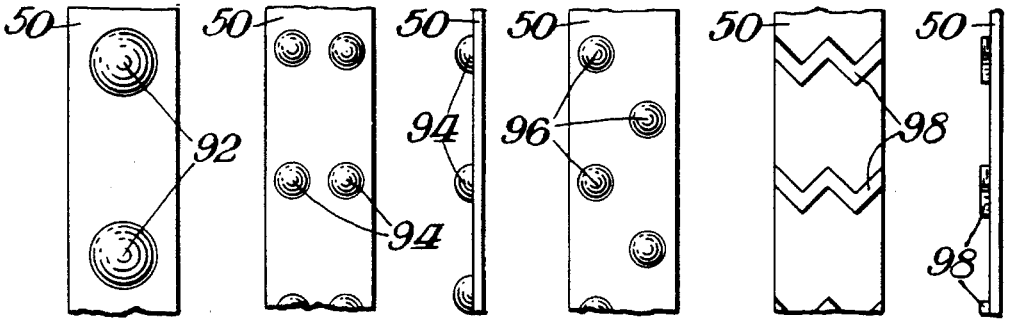
Figures 19, 20, 21, 22, 23, 24, 25:
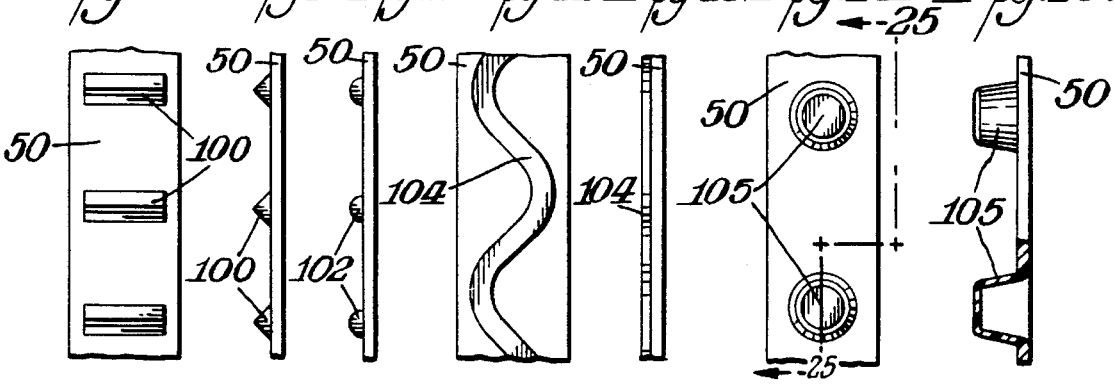
Figure 26:
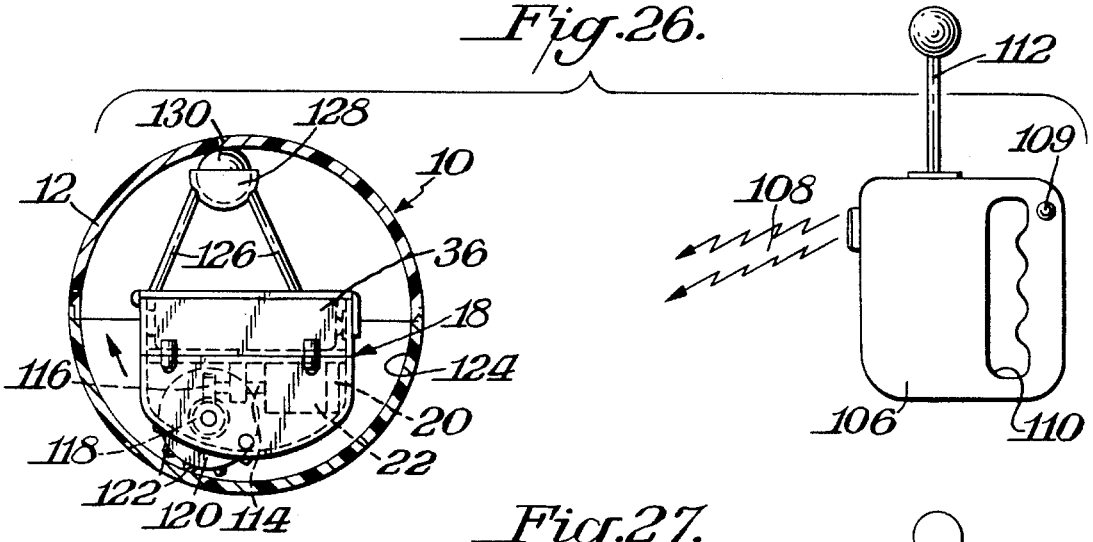
Figure 27:
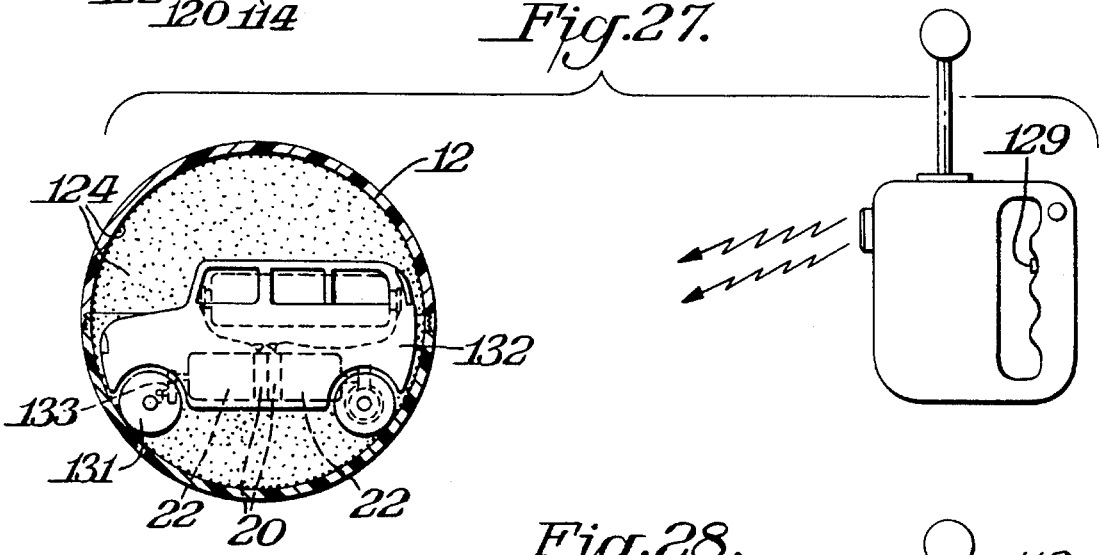
Figure 28:
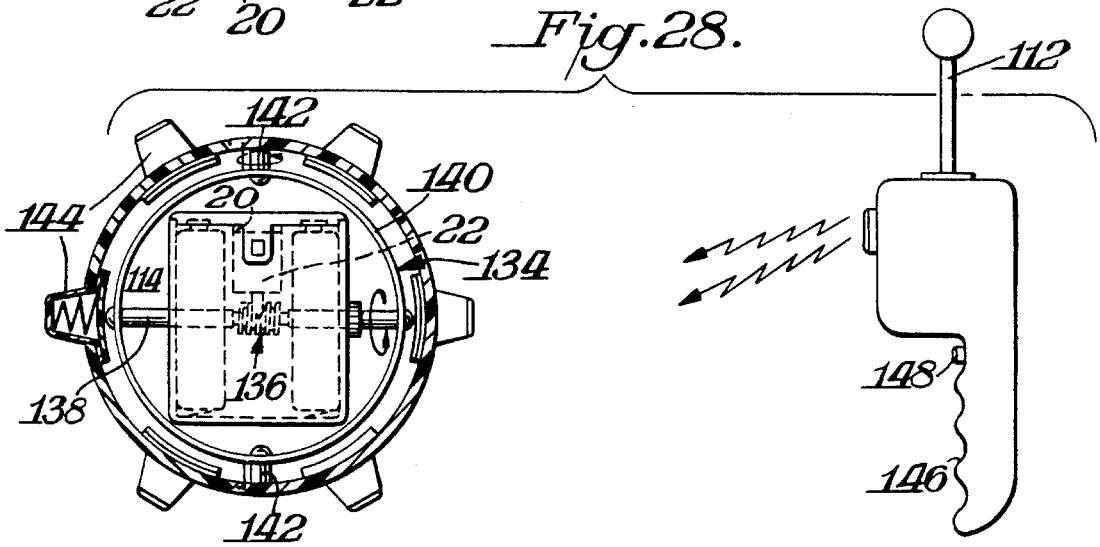
Figure 29A:
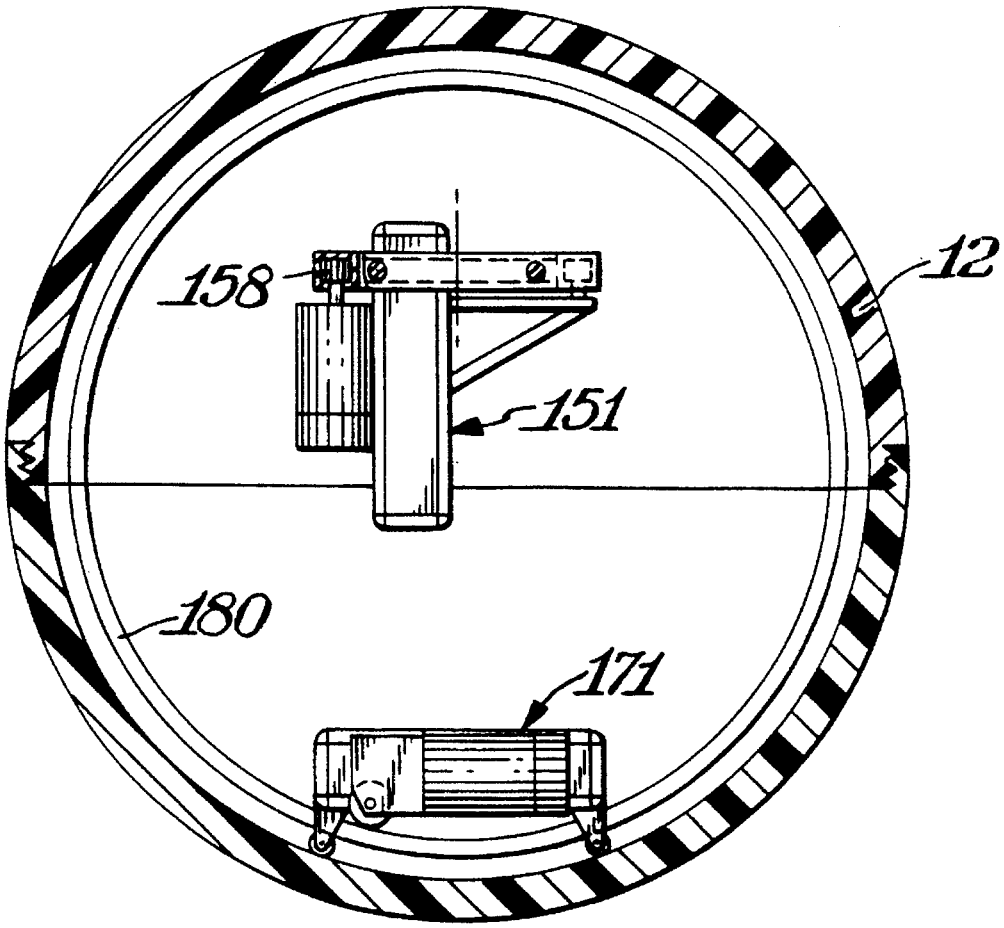

FIG. 1 along the lines 3—3 and 4—4, respectively;

FIG. 5 is a fragmental elevational view of a portion of the ball shown in FIGS. 1–4 illustrating light and sound effects arrangement;

FIG. 6 is a cross-sectional view taken through FIG. 5 along the line 6—6;

FIGS. 7–10 are fragmental cross-sectional views showing various means of attaching the ball segments together in accordance with this invention;

FIG. 11 is a fragmental end cross-sectional view showing a circular motion wheel being mounted eccentrically;

FIG. 12 is a fragmental cross-sectional view showing a further modification of this invention;

FIG. 13 is a top plan view of one form of traction means which could be utilized in accordance with this invention;

FIG. 14 is a view similar to FIG. 13 of an alternative form of traction means;

FIG. 15 is a side elevational view of the traction means shown in FIG. 14;

FIGS. 16–17 are a top plan views of yet further traction means in accordance with this invention;

FIG. 18 is a side elevational view of the traction means shown in FIG. 17;

FIG. 19 is a top plan view of yet another form of traction means in accordance with this invention;

FIG. 20 is a side elevational view of the traction means shown in FIG. 19;

FIG. 21 is a view similar to FIG. 20 of a modified form of traction means in accordance with this invention;

FIG. 22 is a top plan view of yet another form of traction means in accordance with this invention;

FIG. 23 is a side elevational view of the traction means shown in FIG. 22;

FIG. 24 is a top plan view of still yet another form of traction means in accordance with this invention;

FIG. 25 is a cross-sectional view taken through FIG. 24 along the line 25—25;

FIG. 26 is a schematic view of the ball unit drive of this invention held in contact with the inner surface of the ball and of the remote control unit;

FIGS. 27–29 are views similar to FIG. 26 of yet further alternative balls in accordance with this invention;

FIG. 29A is a view similar to FIG. 29 showing the propulsion mechanisms in general form.

FIG. 30 is a cross-sectional view taken through FIG. 29 along the line 30—30;

FIG. 31 is a schematic view of a ball in accordance with this invention being controlled to move along various paths; and FIG. 32 is a schematic showing of yet another form of ball in accordance with this invention.

DETAILED DESCRIPTION

The present invention is based upon the recognition that if mechanisms similar to those used for the remote control of toy vehicles, such as cars and airplanes could be incorporated in a ball the result would be a unique ball type amusement device which would offer far more entertainment than conventional balls or conventional remote controlled toys.

In the preferred practice of this invention the ball is made from a suitable plastic material which could be formed in two halves or hemispheres, although it is not necessary that the segments be precisely halves. What is desired is that the two segments are initially separable so that the necessary propulsion mechanism can be installed and then the segments can be either temporarily locked together or permanently sealed.

In the preferred practice of the invention one or more propulsion mechanisms are mounted within the hollow sphere so that there can be effected a change in the ball speed and/or direction. The resulting motion could be either random or controlled. Thus, the term remote control is used in its broadest sense, namely that there is a remote control of the initiation and duration of the movement. Although the direction is also preferably controlled the invention may be broadly practiced with random movement. Where there is controlled movement, the movement is preferably forward/backward and laterally or left/right.

FIGS. 1–4 illustrate a remote controlled movable ball amusement device 10 in accordance with this invention. As shown therein the device or ball 10 includes a hollow sphere 12 which is formed from two segments 14,16 preferably hemispheres. By forming the sphere in two segments it is possible to install a propulsion mechanism 18 within the ball. The propulsion mechanism 18 includes a receiver 20 and at least one motor 22. In the embodiment illustrated in FIGS. 1–4 the propulsion unit includes two receivers 20,24 and two associated motors 22,26 with the propulsion unit formed by receiver 24 and motor 26 being electrically connected to motor 22 so that a single transmitter could provide a signal for both receivers.

Motor 22 has a rotatable shaft mounted to yoke 28. Thus, when the shaft of motor 22 is rotated yoke 28 also rotates. Motor 26 is mounted to yoke 28 and has its shaft extend into connection with movable weight 30 in the form of a wheel 29. Movable weight 30 is provided with a plurality of holes 32 into which weights 34 may be selectively mounted for varying the degree of motion that would result from the rotation of weight 30 when driven by motor 26. The motors 22,26 are powered by a battery unit 36 which may include an on/off switch 38 for providing the user with the capability of inactivating the propulsion device so that the ball 12 could be used in a conventional manner.

Any suitable techniques may be used for applying the individual weights 34 to the movable weight 30. For example, in the illustrated form the individual weights 34 could simply be weighted screws which would be screwed into the threaded holes 32.

The propulsion mechanism 18 may be mounted to the inner surface of the ball 12 in any suitable manner such as by mounting lugs 40. Movable weight 30 may be secured to shaft 42 of motor 26 in any suitable manner such as by means of a key 44 as best illustrated in FIGS. 3 and 4. By mounting the individual weights 34 into the movable weight 30 it is possible to alter the speed of movement of ball 12.

The various figures illustrate the electrical wiring 46 connected to the battery pack 36 and to the various motors and receivers. An electrical wiper 48 makes contact to power the motors.

The outer surface of ball 12 may be provided with friction or traction bands 50 which would have a greater coefficient of friction than the remaining smooth portions of the outer surface of ball 12. Thus, when the smooth portions contact the floor the ball would tend to move faster than when the bands or mats 50 contact the floor. This adds variety in the movement of ball 12. Further variety may be added by providing the various types of pads for projections such as the projections 52 illustrated in phantom in FIGS. 1 and 3 as being located in select areas such as in a single cluster.

In operation when a signal is received by the receivers 20,24 motor 22 causes yoke 28 to rotate and thus drive the propulsion mechanism 18. Motor 26 causes moveable weight 30 to rotate which controls the speed of movement of ball 12. As later discussed with respect to FIGS. 26–32, a suitable transmitter is utilized to send the signals received by the receivers. As the ball rotates it moves in a direction controlled by the direction of rotation of shaft from motor 22. If motor 22 is a reversible motor the rotation of yoke 28 could be reversed to thereby control the forward or backward direction of ball 12.

The entertainment value of ball 12 can be enhanced by, for example, including colored alpha-numeric symbols 54 which would distinguish one ball from another and would thus lend device 10 to be used in conjunction with a plurality of devices each operated by different individuals.

The invention may also be practiced by incorporating video and audio affects. FIGS. 5–6, for example, illustrate a light display 56 exposed through an opening in the outer surface of ball 12. A sound or audio unit 58 may also be provided which could be periodically actuated by, for example, depression of a plunger 60 during rotation of ball 12. Plunger 60 would be associated with a pressure sensor 62 electrically connected to audio unit 58. Pressure sensor 62 would also be connected to the light display 56 by the wiring 64 as illustrated in FIG. 6.

The two segments 14,16 of ball 12 may be connected in any suitable manner such as by the lap joint 66 illustrated in FIGS. 3 and 4.

Figure 7:
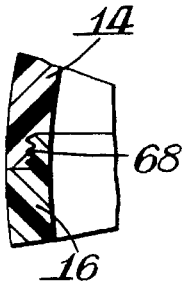
Figure 8:
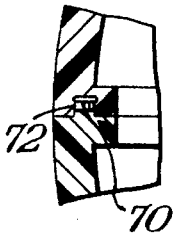
Figure 9:
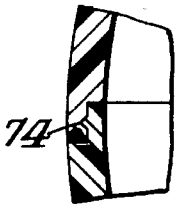
Figure 10:
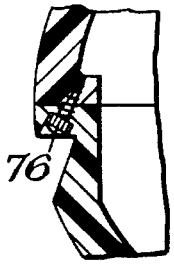

FIGS. 7–10 illustrate other manners of securing the segments 14,16 together. FIG. 7, for example, illustrates the joint to be by means of a threaded connection 68. FIG. 8 illustrates a detent 70 mounted in a socket 72. FIG. 9 illustrates a snap fit 74. FIG. 10 illustrates as a safeguard the provision of a screw 76 or other suitable type fastener which can be used in place of or in addition to the other types of joints.

FIG. 11 illustrates an alternative manner of providing motion to ball 12. As shown therein an eccentrically mounted wheel 78 is secured to the shaft of the motor so that the eccentric rotation causes the ball to move in a forward or backward direction depending on the direction of movement of the motor shaft.

FIG. 12 illustrates a further modification of the invention wherein a bounce mechanism 80 is provided. Bounce mechanism 80 includes a solenoid 82 having a pad 84 mounted at the end of its arm 86 at a location where a resilient cover 88 is provided on the outer surface of ball 12. When a signal is sent to solenoid 82 the extension of arm 86 causes the pad 84 to project outwardly beyond the normal circumference of ball 12. If this occurs as the ball is contacting the support surface 90 the ball would be caused to bounce.

FIGS. 13–25 illustrate various forms of projections used to alter the movement of ball 10. The projections are preferably in one or more clusters at one or more locations of the ball such as shown in FIGS. 1 and 3.

As shown in FIG. 13 each traction strip 50 is provided with a row of semi-circular outwardly extending pads 92.

FIGS. 14–16 illustrate sets of aligned semi-circular pads 94 on strip 50. FIG. 14 shows aligned pads 94. FIGS. 16 show the pads 96 to be in a random pattern.

FIGS. 17–18 illustrate the raised pads 98 on band 50 to be in a plurality of sawtooth patterns.

FIGS. 19–20 illustrate the pads 100 to be of elongated construction and extending triangularly outwardly from band 50.

FIG. 21 illustrates the outward extension of pads 102 to be semi-circular rather than triangular as in FIGS. 19–20.

FIGS. 22–23 illustrate the pad 104 to be in the form of a serpentine strip.

FIGS. 24–25 illustrate frusto-conical pads 105 on the band 50.

FIGS. 26 illustrate a practice of the invention which also shows the hand held transmitter 106 for sending signals 108 to ball 10. Transmitter 106 also includes an on/off switch 109. Transmitter 106 would have a handle opening 110 and a joy stick 112 which could be moved back and forth and from side to side (see FIG. 31) to control the back and forth and lateral movement of ball 10.

In the embodiment shown in FIG. 26 the propulsion mechanism 18 includes a receiver 20 mounted to motor 22 with the motor shaft 114 driving a gear 116 to drive pinion 118 which in turn drives wheel 120 having teeth or frusto-conical pads 122 engaged in movable contact with the inner surface 124 of ball 10. The propulsion mechanism 18 includes struts 126 connected to a roller cup 128 having a stabilizer roller guide 130 to assure that teeth or pads 122 maintain contact with the inner surface 124 of ball 10.

FIG. 27 illustrates a further variation of the invention wherein the hollow ball 10 includes as its propulsion mechanism a conventional toy vehicle 132 which is radio controlled in the same manner as conventional radio controlled vehicles. The advantage of this embodiment is that the ball 10 can be selectively opened and the user could be entertained by controlling the movement of vehicle 132 directly on a support surface or alteratively the vehicle 132 could be housed within ball 10 and the signals 108 would be received by the pair of receivers 20 associated with motor 22 in vehicle 132.

The vehicle 132 may also include steering drives 133 which extend from the respective motors 122 to rotate the wheels 131 which movably engage the inner surface 124 of ball 12. Thus the vehicle 132 has both front and rear wheel drive.

A further variation of the invention illustrated in FIG. 27 is that transmitter 106 includes a timer switch 129 which would automatically turn off the transmitter after a set period of time such as one minute to conserve the battery energy.

FIG. 28 illustrates a further variation of the invention wherein the propulsion mechanism is a gyroscope assembly 134 which provides for movement about both the x and y axes. As shown therein, the shaft 114 of motor 22 drives a worm and pinion arrangement 136 to rotate shaft 138 in the direction indicated by the arrow. Shaft 138 is mounted to gyroscope ring 140 which also has a rotational movement about shaft 142 as further indicated by the corresponding arrow.

FIG. 28 illustrates variations of the invention wherein the pads provided on ball 10 are in the form of spring pads 144.

A further variation illustrated in FIG. 28 is in the transmitter 106 having a different grip assembly wherein the hand grip 146 is exposed with the on/off switch 148 mounted at the hand grip 146.

In the embodiment illustrated in FIG. 28 the drive unit could be eccentrically mounted rather than being centrally mounted as illustrated.

FIGS. 29–30 illustrate yet another embodiment of this invention which has two independently movable propulsion mechanisms. FIG. 29 illustrates the incorporation of the two independently movable propulsion mechanisms 151, 171. Mechanism 151 rides on track 158, while mechanism 171 rides on track 180 within ball 12. FIG. 29 shows the propulsion mechanisms 151, 171 on an enlarged scale for purposes of more clearly illustrating the components of the propulsion mechanisms. Obviously, there would have to be sufficient clearance for the propulsion mechanisms to move past each other as shown in FIG. 29A. FIG. 29, however, better illustrates the details of the actual mechanisms. As shown therein receiver 150 actuates motor 152 to rotate its shaft 154. Rotation of shaft 154 causes friction wheel or gear drive 156 to rotate in track 158 causing rotation of the drive unit and receiver about the axes 160 as indicated by the arrow. An idler/stabilizing wheel 162 is mounted at the opposite end of wheel 156 in the O-shaped track. A stabilizer arm 164 is mounted to battery container 166 for supporting wheel 162. A plurality of, such as four, spacer mount rods 168 extend from the outer surface of track 158 to stabilize the circular track so that the drive unit may move in an arcuate direction about the center line or axis 160 mounted in the center of the arcuate path.

FIGS. 29 and 30 illustrate the second drive unit which includes a receiver 170 which actuates the motor 172 for rotating the shaft 174 to drive worm/pinion drive 176. Worm/pinion drive 176 in turn rotates drive wheel 178 mounted in circular track 180. A pair of idler wheels 182 ride against the inner surface 124 of ball 12.

The arrangement of FIGS. 29 and 30 thus cause simultaneous movement of two different propulsion mechanisms within ball 12 to alter the pattern of movement of the ball itself.

FIG. 31 schematically illustrates how the invention could be practiced by use of the joy stick 112 on the transmitter 106 causing the ball 12 to alter its path of movement.

FIGS. 32 illustrates a further variation of the invention wherein the transmitter or remote control unit 184 is physically connected to the ball 12 by means of an electrical cable 186 which sends electrical signals, rather than radio signals, to the propulsion mechanism 188 within ball 12. This arrangement would be similar to known arrangements for controlling from a distance objects such as vehicles.

One general manner of practice of the invention would be to provide a propulsion mechanism which moves in a suitable track on the inside of the ball which in turn causes movement of the ball. The track could be of any suitable structure such as grooves, ridges, holes, surface squares, etc.

The invention lends itself to a wide number of variations to enhance or alter its entertainment appeal. For example, the balls can be decorated or colored on the outside with faces, symbols, numbers, etc. By providing audio and visual effects the ball can be made to emit a sound such as a beep or to flash a light in the manner previously described. Alternatively, timing mechanisms may be used to control the sound or light.

Where the ball is made of a pair of segments the segments could be locked together in various manners such as pressure fits, holes in posts, track and groove, etc. This would prevent the ball segments from separating while in play but permit the ball to be open by hand either by children or adults to gain access to the motor unit. This would be particularly desirable where the motor unit in itself is a toy, such as vehicle 132. The inside of the ball could also be coated or lined with a material or substance which would provide better traction for the drive wheels of the propulsion mechanisms.

The propulsion mechanisms could include one or more drive units, each of which would have its own motor and each of which could have one or more drive wheels.

Similarly, each drive unit could have one or more shafts or axles.. The drive units could be structured to move in a single direction or in multiple directions including directions perpendicular or at a non-perpendicular angle to each other. The wheels of the drive unit could be fixed or could be capable of turning.

The drive units could move freely inside the ball or could move along a track as previously described. Where two or more drive units are used all of the drive units could be moved in the same direction or could be moved in different directions at the same or different speeds.

The ball may be designed as, in effect, a ball within a ball where movement of the inner ball causes movement of the outer ball. Such an arrangement could include an outer drive between the outer surface of the inner ball and the inner surface of the outer ball which would propel the ball in one or more directions and an inner drive against the inner surface of the inner ball which would propel the ball in one or more directions different from the outer drive. Thus, for example, the outer drive might propel the ball forward or backwards while the inner drive might propel the ball laterally.

The ball could have one or more tracks on its inner surface that could hold a corresponding number of drives. Thus, for example, the ball could have a circular track for one drive and then another circular track at a right angle to the first track. In this way, a drive unit on each track could propel the ball in perpendicular directions.

The ball could also have a rotating but not fixed circular wheel or track on the inside mounted on a motor driven shaft. The track could also have a drive unit. A wheel within the ball extending diametrically across the inner surface of the ball could spin when the drive unit moves forwards or backwards. This would impart speed to the ball. The motor driven shaft would rotate the spinning wheel to alter the direction of the ball.

Where the ball includes a rotating circular wheel such as wheel 29 which is unequally weighted by use of detachable weights 34, the ball could have a turning or spinning motion imparted thereto.

The ball of this invention is capable of being used for pure entertainment purposes by having one or more individuals with a corresponding number of balls simultaneously controlling the respective balls. The ball may also be used for more controlled sports or games such as racing various balls, as a replacement for a hockey puck in a game, for use in an obstacle course, for simulated ski jumping, slalom, tag, bowling, touch football, soccer, pool and billiards, simulated sumo wrestling.

A further advantage of the ball of this invention would be as an amusement device for pets such as cats or dogs who would be intrigued by watching movement of the ball and attempting to catch the ball, such as a cat hunting its prey.

Although the invention has been particularly described with respect to the remote unit sending radio or electrical signals to the ball, the invention may also be practiced where the signals are sent in other manners. Thus, for example, a mechanical linkage could connect the remote unit with the ball and the signals could be considered mechanical signals.

The invention could also be practiced by mounting one or more magnets in the ball. This could be accomplished by having the ball attracted to or repulsed by another ball or by magnets on the floor or a wall depending on whether the magnet polarity near the surface of the ball is opposite (attraction) or the same (repulsion) as a magnet of another ball or wall or floor. This arrangement would lend itself to games having as a goal manipulating the movement of the ball so that one player tries to attract the balls together while another player tries to repel the balls. The game could be made more complicated by using three or more players. A single player (or plural players) could use magnets on wall or floor to affect movement of the ball.

It is to be understood that various features described with respect to different embodiments may be used with other embodiments within the spirit of this invention.

What is claimed is:

1. A remote controlled movable ball amusement device comprising a sphere, said sphere being hollow and having an internal surface and an outer surface, a first endless track mounted to said internal surface, a first propulsion mechanism movably mounted in said first track, a second endless track mounted to said internal surface, a second propulsion mechanism movably mounted in said second track, said propulsion mechanisms jointly forming a mass within said sphere, each of said propulsion mechanisms including a drive unit and a receiver, a remote transmitter for sending signals to each of said receivers of said propulsion mechanisms, each of said receivers actuating its respective drive unit in response to said signals being received, and said propulsion mechanisms being operative independently of each other to permit a user to vary the movement of said sphere in accordance with the actuation of said propulsion mechanism to shift the center of gravity of said mass as said propulsion mechanisms move in their tracks.

2. The device of claim 1 wherein at least one of said propulsion mechanisms include means for varying the speed of said sphere.

3. The device of claim 1 wherein said sphere includes periodically operable light means and audio means.

4. The device of claim 1 including traction bands on the outer surface of said sphere with the portions of said sphere between said traction bands being of a lesser coefficient of friction.

5. The device of claim 1 including a plurality of projections extending outwardly from said outer surface of said sphere.

6. The device of claim 1 wherein said sphere comprises a pair of partial spherical segments joined together to form said sphere.

7. The device of claim 6 wherein said transmitter includes a joy stick for controlling the direction of movement of said sphere.

8. The device of claim 4 including a plurality of projections extending outwardly from said outer surface of said sphere.

9. The device of claim 8 wherein said projections are located in a cluster on said traction bands.

10. The device of claim 6 wherein said segments are detachably mounted together to provide access to the interior of said sphere.

* * * * *